United States Patent [19]

Kastner

[11] 4,290,592

[45] Sep. 22, 1981

[54] APPARATUS FOR PAPER INTERLEAVING AND SEVERING

[76] Inventor: Arnold Kastner, 10220 Armand Lavergne, Montreal, Quebec, Canada

[21] Appl. No.: 109,094

[22] Filed: Jan. 2, 1980

[30] Foreign Application Priority Data

Dec. 6, 1979 [CA] Canada ..... 341322

[51] Int. Cl.[3] ..... B41L 1/30

[52] U.S. Cl. ..... 270/40; 83/96; 83/320; 270/21.1; 493/343; 493/356

[58] Field of Search ..... 270/21, 40/41; 83/96, 318, 320

[56] References Cited

U.S. PATENT DOCUMENTS 654,515 7/1900 Casterline ..... 270/40

3,291,678 12/1966 Enloe ..... 270/40

4,196,645 4/1980 Shimizu ..... 83/320

FOREIGN PATENT DOCUMENTS 688144 2/1950 United Kingdom ..... 270/40

*Primary Examiner*—J. Reed Fisher

*Assistant Examiner*—A. Heinz

*Attorney, Agent, or Firm*—Browdy and Neimark

[57] ABSTRACT

Process and apparatus for folding and interleaving continuously moving strips of paper and cutting the interleaved strips into packets of interleaved paper sheets. A supply roll of paper strip is provided for each sheet of paper in a packet, and the strips are simultaneously drawn from the supply rolls and through a series of formers and interleavers to provide a continuously moving strand of interleaved paper strips. The packets are cut from the continuously advancing strand by severing means which moves along with the strand during cutting.

8 Claims, 8 Drawing Figures

APPARATUS FOR PAPER INTERLEAVING AND SEVERING

The present invention relates to process and apparatus for interleaving paper strips, and more particularly relates to the interleaving of paper strips and the subsequent severing of a plurality of interleaved strips into stacks or packets of specific length. The invention has particular application to the interleaving of flat cigarette papers which are packaged and sold in small booklet form.

Flat cigarette papers which are used to make cigarettes are sold in flat booklets. These booklets usually carry two individual stacks or packets or interleaved cigarette paper sheets, with one longitudinal edge of each sheet usually being provided with a line of glue or adhesive to facilitate cigarette making.

DESCRIPTION OF PRIOR ART AND TECHNIQUES

Conventionally, the interleaving of cigarette paper is accomplished by the use of intermeshing so-called star wheel assemblies wherein pre-cut lengths of paper are fed to the star wheels and the intermeshing of the star wheels results in the interleaving of the individual sheets ready for packaging in book form. While such star wheel assemblies do function to provide acceptable interleaved stacks, these prior art devices do have some major disadvantages. One disadvantage is that these prior arrangements are wasteful and a lot of paper is lost during the course of production. With the prior devices, each sheet of cigarette paper is initially cut and is then fed to the star wheel assemblies and it is during this movement that the majority of the wastage occurs. Individual paper sheets are passed to the star wheels, and direct gripping contact with the individual sheets is not possible at this point and the sheets are very loosely fed to the star wheels. It is because of this imprecise feeding that wastage occurs. Additionally, it will be appreciated that unless the individual strips are precisely fed to the star wheels that an unsatisfactory packet of interleaved sheets will result. A further disadvantage of the prior art arrangements is that for satisfactory functioning, the moisture content of the cigarette paper is very critical, and in many instances humidity control in the surrounding atmosphere is important or alternatively the moisture content of the cigarette paper must be at a very specific degree before the paper can satisfactorily be interleaved into the finished packet.

A further disadvantage of the prior art devices is their rather low production rate which cannot be increased past a certain speed because of the mechanisms involved.

Canadian Pat. No. 420,552 granted May 30, 1944 to H. A. Brown is representative of these prior art interleaving machines.

Also representative of these prior art machines are British Pat. Nos. 476,036—July 14, 1936 and 495,950—May 2, 1938, which cover apparatus well known in the trade as the "Lerner" machine.

DESCRIPTION AND OBJECTS OF THE PRESENT INVENTION

The present process and apparatus avoids the difficulties inherent in the prior art devices, and enables higher productivity with little or no waste at all.

The present invention avoids the problems of the prior art devices by interleaving continuous separate lengths of cigarette paper coming from individual supply rolls prior to the severing of the interleaved paper lengths into individual stacks or packets of desired length. At all times during the production of interleaved packets according to applicant's process and apparatus, the cigaratte paper is held in a positive manner and as a result the successful operation of the present invention is not dependent upon the moisture content of the paper itself or on the humidity or atmospheric conditions surrounding the apparatus when in use.

The principal object of the present invention then is to provide process and apparatus for folding and interleaving continuously moving endless strips of paper and cutting the interleaved strips into packets of desired length, and which avoids the problems and difficulties inherent in the prior art devices and provide a high rate of productivity with a minimum of waste.

More specifically, an object of the present invention is to provide apparatus for folding and interleaving moving endless strips of paper and cutting the interleaving strips into packets of interleaved paper sheets comprising, a plurality of rotatably mounted rolls of paper strip for continuously supplying endless lengths of paper strip, and a series of formers positioned sequentially outwardly from the supply rolls to fold and interleave the strip material, and drive means for continuously withdrawing strip material from the supply rolls and through the formers, to form a strand of interleaved paper strips, and severing means for cutting the strand of interleaved paper strips into interleaved packets of paper sheets of predetermined length, and means to move the severing means in the same direction and at the same speed as the moving strand during cutting.

In addition, an object of the present invention is to specifically provide a process for folding and interleaving moving endless strips of paper and cutting the interleaved strips into packets of interleaved paper sheets of desired length, each packet having a predetermined number of individual sheets, comprising providing a supply roll of paper strip for each sheet of paper in a packet, simultaneously drawing strips of paper from the supply rolls and through a series of formers and interleavers to provide a continuously moving strand of interleaved paper strips, and severing the strand to provide the packets of a desired length during continuous movement of the paper strip material.

BRIEF DESCRIPTION OF ACCOMPANYING DRAWINGS

The invention will now be more fully described and understood with reference to the accompanying drawings wherein.

DETAILED DESCRIPTION OF ACCOMPANYING DRAWINGS

Figure 1:
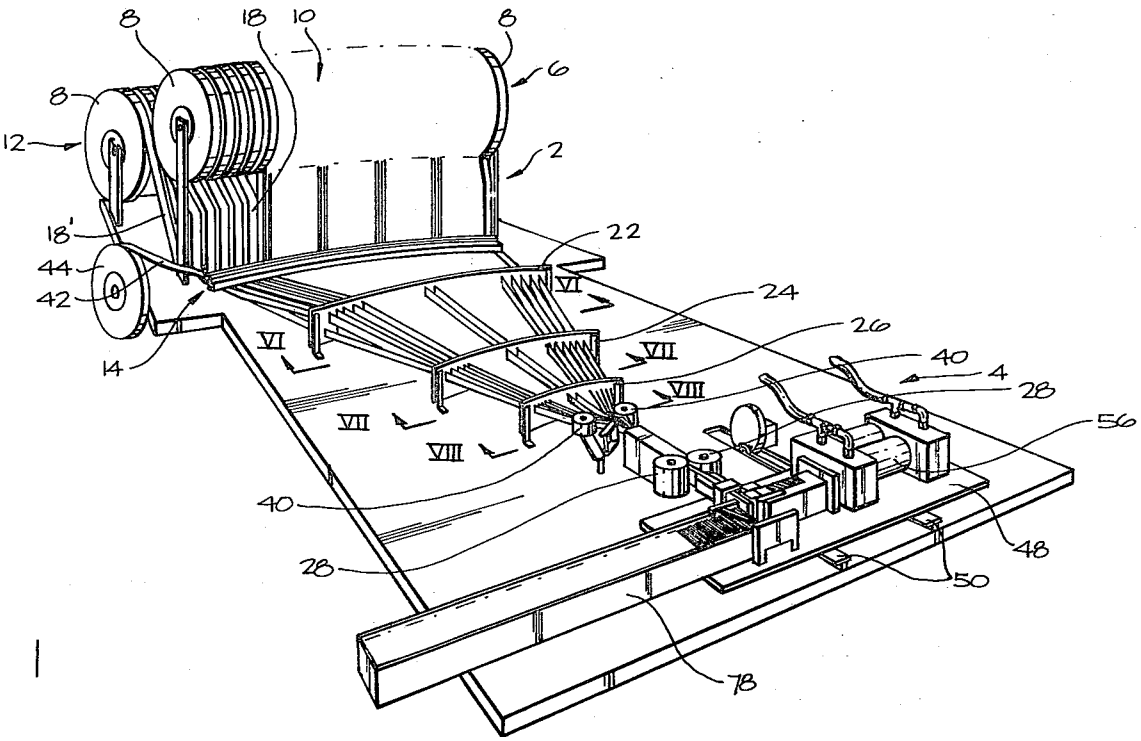
FIG. 1 illustrates the apparatus of the present invention in perspective view.

The attached drawings will now be described in more detail with reference to the accompanying drawings wherein like reference numerals identify like parts.

For purposes of description and understanding, the present invention can be considered to be consisting of two major assemblies, the first assembly being shown generally by numeral 2 in FIG. 1, consisting of apparatus for interleaving continuous lengths of paper strip; the second assembly shown generally by numeral 4 consisting of apparatus for severing the interleaved strips of paper into stacks or packets of desired length.

The forming and interleaving of a plurality of continuous lengths of cigarette paper into compacted interleaved form will now be discussed, this arrangement being shown generally by numeral 2 in FIG. 1.

The cigarette paper which is to be interleaved and severed into stacks or packets of interleaved paper sheets is drawn from supply rolls shown generally by numeral 6. The number of supply rolls used will determine the number of individual interleaved sheets forming each interleaved packet. For example, if an interleaved packet is to consist of fifty interleaved sheets, then fifty individual supply rolls 8 will be used. Fifty individual paper supply rolls 8 are shown in FIG. 1 with twenty-five of the rolls forming an upper bank 10, and twenty-five of the rolls forming a lower bank 12. Each of the rolls 8 are mounted for free rotational movement to rotate freely as paper strip material is drawn therefrom.

The provision of upper 10 and lower 12 banks of supply rolls 8 enables an overall reduction in the size of the machine. Such an arrangement is, however, not absolutely necessary and the rolls could occupy two rows at the same level, and if space is not a consideration, all rolls 8 could be arranged in a single curved row.

Figures 3, 4, 5:
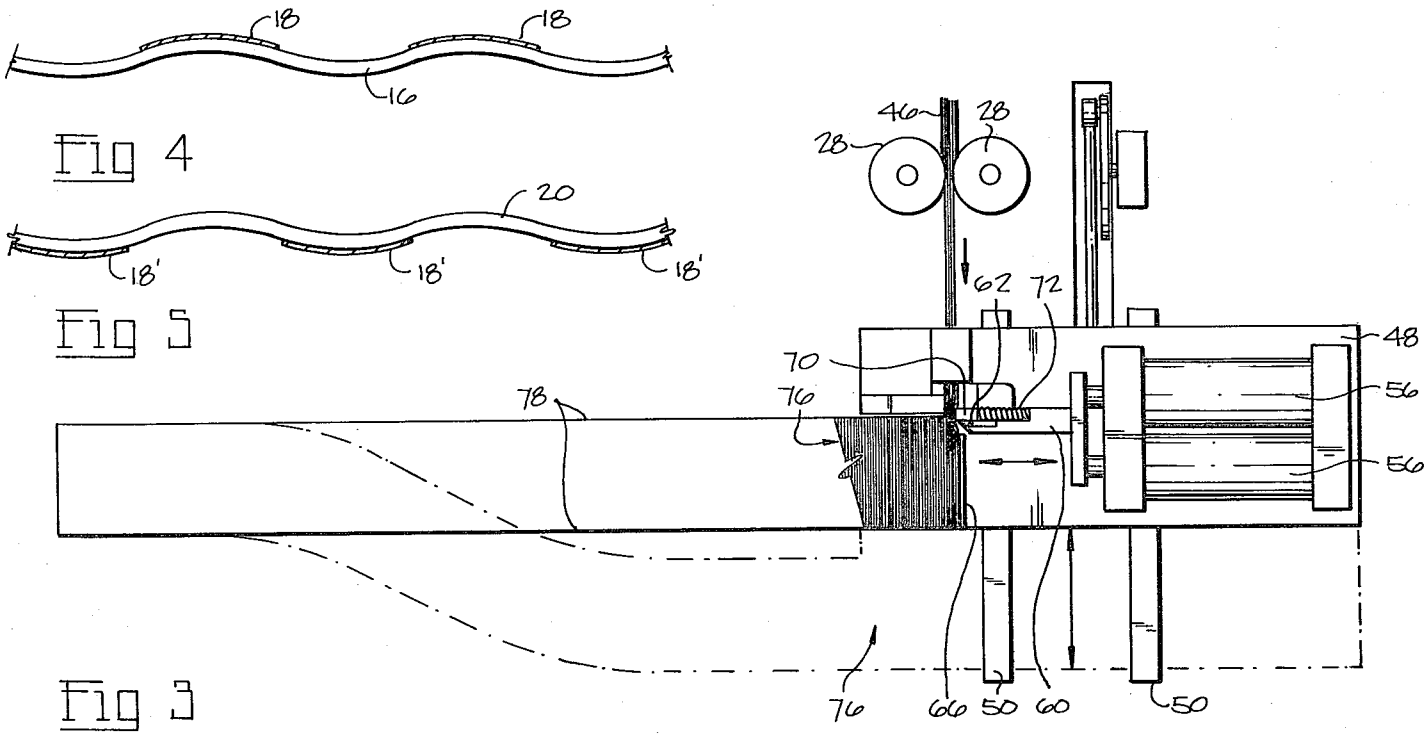
FIG. 3 illustrates in plan view a further position of a paper severing assembly.
FIGS. 4 and 5 are enlarged schematic views of paper pre-formers; and appear on the sheet with FIG. 3.

Paper strip material drawn from the rolls 8 moves forwardly for interleaving and subsequent severing and in the area shown generally at 14 the paper strips may pass around guide rolls (not shown) and over (or under) paper strip pre-formers, the latter being schematically shown in an enlarged section in FIGS. 4 and 5. In FIG. 4, an undulating paper strip preformer 16 is shown, and paper strips 18 from adjacent rolls 8 of the top bank 10 are drawn over the preformer 16 as shown to impart to the paper strips an unwardly convex configuration as shown.

FIG. 5 shows a further undulating paper strip preformer 20 and paper strips 18' from adjacent rolls 8 of the lower bank 12 are drawn under the pre-former 20 as shown to impart to the paper strips an upwardly concave configuration as shown.

The paper strip material is then drawn forwardly through a series of paper formers (folders) and interleavers and in FIG. 1, three individual formers and interleavers are shown at 22, 24, and 26, but as this description continues, it will be appreciated that more or less individual forming and interleaving assemblies can be utilized as required. To form and interleave, strip material from each of the rolls 8 is fed along an individual specific path and all of the strips of material converge between pressing and drive rollers 28 which rotate continuously at a constant rate to draw the paper strip material from the rolls and through the formers into interleaved relationship. The drive of drive rollers 28 is continuous and is not intermittent so that rotation of the individual rolls 8 is also continuous which minimizes or completely eliminates any breakage in the paper strips issuing from the rolls. Should the drive rollers 28 be of intermittent rotation, this would cause a stoppage in the rotation of rollers 8 resulting in stationary inertia which could possibly result in a breakage of the paper strips when once again the drive rollers 28 are rotated.

Figure 6:
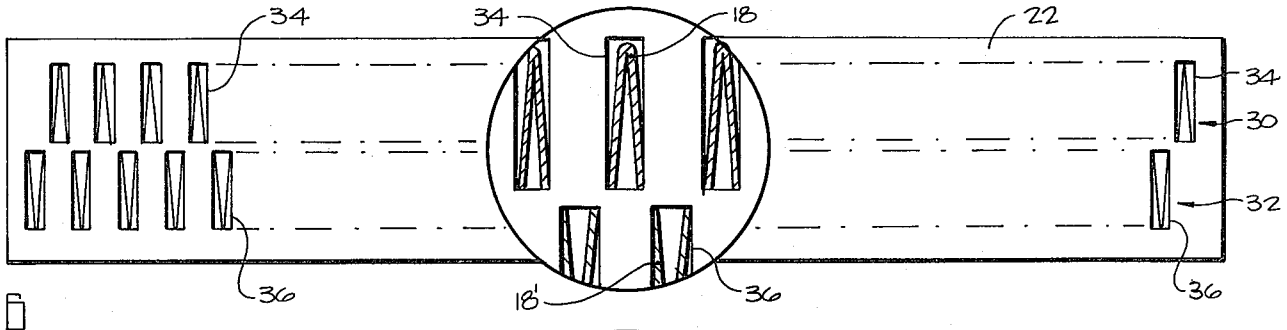
FIG. 6 illustrates in enlarged front view a first former for paper interleaving; taken along line VI—VI of FIG. 1.

FIG. 6 is an enlarged front view of the first paper former 22. From FIG. 6, it will be seen that this former is provided with upper 30 and lower 32 horizontal rows of openings with the openings 34 of the upper row being horizontally staggered or offset with respect to the opeings 36 in the lower row. The strips 18 of paper from the rolls 8 in the upper bank 10 pass separately and in sequential order through the apertures 34 in the upper row; there being an opening 34 in the upper row 30 for each roll of paper in the upper bank 10. It will be seen that the paper strip 18 passes through these openings in inverted V- or U-shaped configuration. This configuration once imparted into the paper strips will result in a continuation of this configuration as the paper strips are withdrawn from the supply rolls.

Similarly, the strips of paper 18' being supplied from the rolls 8 of the lower bank 12 are individually and in order fed through the openings 36 provided in the lower row 32 of openings provided in the former 22. In this latter case, however, an upwardly opening V- or U-shaped configuration is imparted to the paper strip 18' as will clearly be understood with reference to accompanying FIG. 6.

Figure 7:
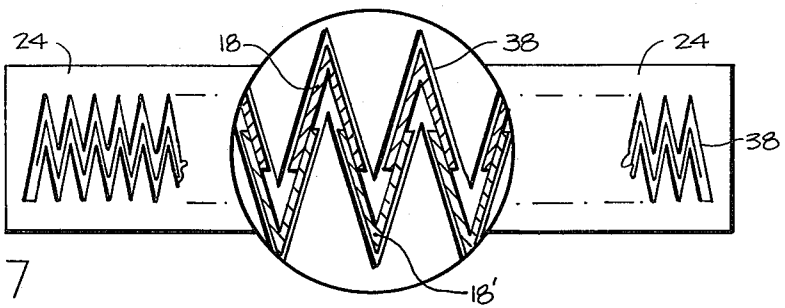
FIG. 7 illustrates in enlarged front view a second former for paper interleaving taken along line VII—VII of FIG. 1.

The paper strips are drawn through former 22 and then into a second former and interleaver 24 which is shown in enlarged front view in FIG. 7. This former 24 has a former and interleaving opening 38 of generally zig-zag or sawtooth configuration as clearly shown, with each of the upper 18 and lower 18' strips of paper occupying a respective one of the V- or inverted V-configurations provided therein. The upper strips 18 of cigarette paper will pass through the upwardly pointing sections of inverted V-shape of the former in the position as shown; whereas the strips of paper 18' which have been formed into U-shaped configuration in former 22 will occupy the downwardly pointing sections of V-shape in the former 24. The partial interleaving of the various cigarette paper strips 18 and 18' is clearly shown in the enlarged portion of FIG. 7 of the accompanying drawings.

Figure 8:
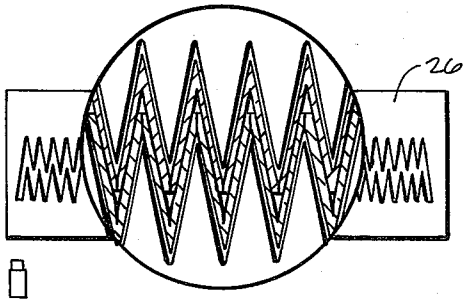
FIG. 8 illustrates in enlarged front view a third former for paper interleaving taken along line VIII—VIII of FIG. 1.

The partially interleaved cigarette paper strips 18 and 18' are then drawn from former 24 through a third former 26 which results in a complete interleaving of the paper strips as shown in FIG. 8. The interleaved paper strips then are drawn from former 26 through guide rollers 40 and funnelled in compact interleaved manner between drive rollers 28 as discussed above.

If desired, a coloured separation strip 42 may be provided to facilitate separation of finished stacks or packets of interleaved paper after the forming and severing.

The separation strip 42 is supplied from roll 44 and this simply provides a coloured strip of paper 42 along one side of a stack of fifty interleaved sheets.

Figure 2:
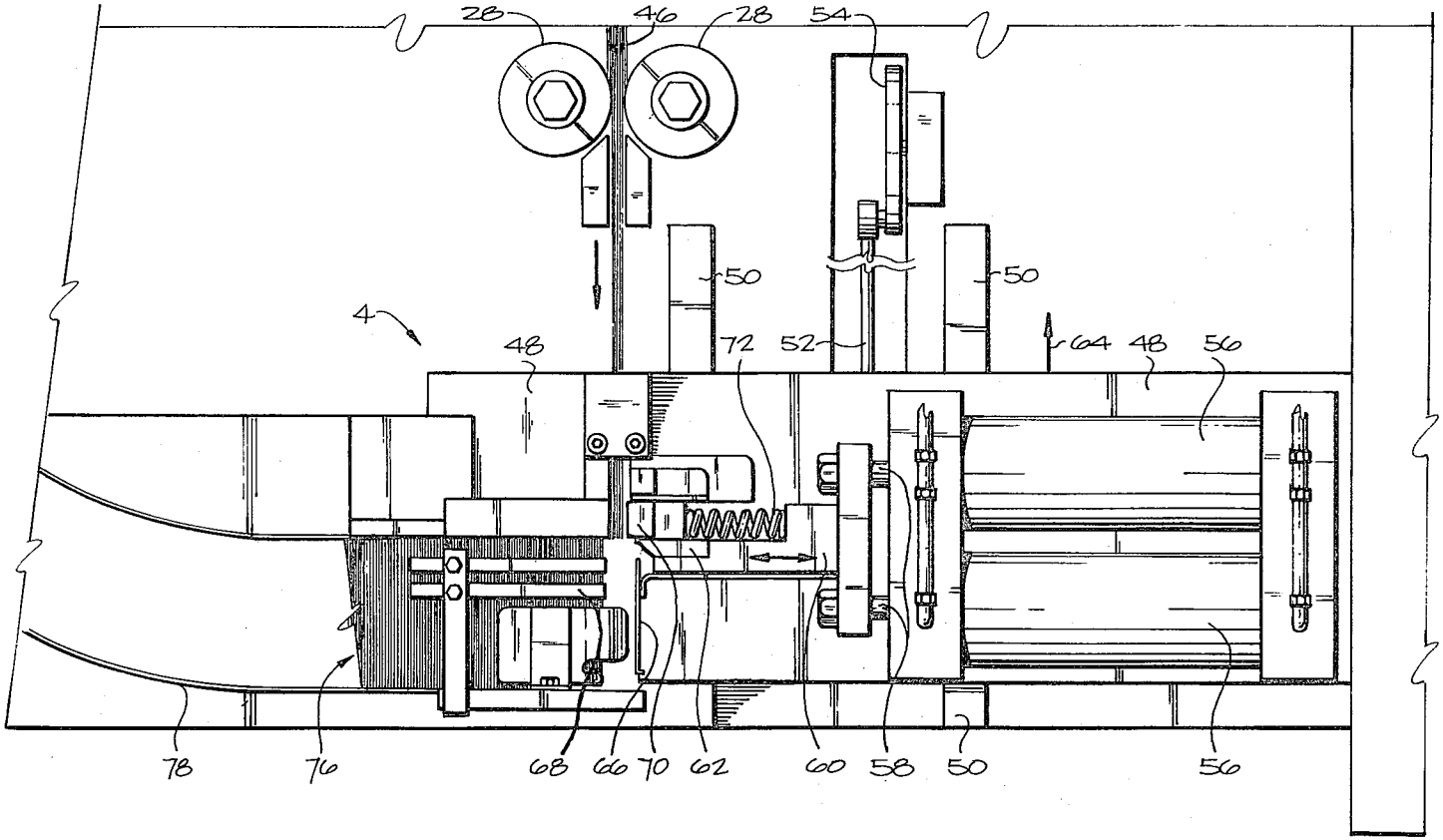
FIG. 2 illustrates in plan view one position of a paper severing assembly.

Reference will now be specifically had to accompanying FIGS. 2 and 3 which show in plan view the severing assembly shown generally by numeral 4 in FIG. 1.

As indicated previously, drive rollers 28 draw a continuous strand 46 of interleaved paper strip material at a constant rate, and the severing assembly shown generally by numeral 4 cuts individual packets of interleaved paper sheets ready for packaging in the cigarette paper booklets as discussed above.

The severing assembly is mounted on a movable platform 48 which is reciprocably movable in the direction of advancement of the paper strip material and in timed relationship therewith. This timing is easily accomplished and the reciprocal movement of the platform is in direct relationship with the rotation of the drive rollers 28, and in fact, rotation of the drive rollers 28 and the reciprocal movement of the platform 48 may be by a single electric motor. Specific details of this single electric drive motor and its relationship with the drive rollers 28 and the reciprocably movable platform 48 are not specifically shown in the drawings for such will be readily understood. However, a brief description of suitable means for effecting reciprocable movement of the platform 48 may be in order. The platform is mounted for reciprocable movement on suitable tracks 50, a drive arm 52 being pivotally secured to the underside of the platform and at the other end being rotatably and eccentrically secured to a drive wheel 54. The drive wheel 54 upon rotation will, of course, result in a reciprocal movement to the platform 48 with this movement having a direct relationship to the rate of rotation of the drive rollers 28.

The movement of platform 48 carrying the severing assembly is required to enable a cutting knife to move along with the travelling interleaved strips 46 so that severing can be accomplished without any interruption or stoppage of the constant flow of interleaved strip material, and enables a precise and clean severing.

Securely mounted on the platform 48 are double-acting pneumatic cylinders 56, the piston rods 58 of these cylinders carrying a knife support plate 60 upon which a severing knife 62 is mounted. It will be appreciated that reciprocal movement of the knife support plate 60 due to movement of the piston rods 58 will result in a reciprocal movement of the knife into and out of cutting relationship with the advancing strand 46 of interleaved paper material. In the position as shown in FIG. 2, the knife 62 has just completed cutting a packet of interleaved paper strips and has returned to its withdrawn position and the platform 48 is then ready for movement in direction shown by arrow 64. The packet of paper which has just been severed by knife 62 having been pushed ahead (to the left as shown in FIG. 2) by a pusher plate 66 which is carried by plate 60 wherein the packet is retained behind spring retaining arms 68.

FIG. 3 illustrates the positioning of the platform 48 at its maximum point of travel towards the oncoming interleaved strip material and in this drawing many details have been omitted for clarity and a better understanding. From the position shown in FIG. 3, the platform follows the movement of the interleaved strip material 46, and it is during this simultaneous movement that the pneumatic cylinders 56 are actuated to extend the knife to effect severing of an interleaved packet of papers.

In order to achieve a precise and clean cut of the interleaved cigarette paper material, a compactor 70 may be mounted forwardly of the knife 62 (with respect to the path of movement of the cigarette paper) this compactor being biased outwardly of spring 72 so that it normally assumes a position in advance of the cutting edge of the knife. The purpose for the compactor is to compact the interleaved papers together to enable the knife to accomplish a clean and precise cut.

In FIG. 3, the forward positioning of the compactor 70 is shown and it will be appreciated that compaction of the paper strip material will occur during outward movement of plate 60 before contact of the knife edge with the paper strips. As the plate 60 advances the knife 62 also advances and the compactor 70 will move rearwardly against the action of spring 72 while at the same time holding the paper in compacted position ready for severing. Once the severing of the paper stack has been completed, the pusher plate 66 will as shown in FIG. 2 press the severed stack forwardly (to the left in FIG. 2) and into the retained position behind the retaining arms 68.

As individual stacks of paper are cut, and moved to the left, they form along with previously cut stacks a row 76 of interleaved and severed sheets and each individual stack or packet may be defined by the presence of a coloured strip 42 of separation material as discussed earlier. This row 76 may be of fairly short length, and an operator may be positioned closely adjacent the apparatus to receive the stacks and pack them in booklet form. However, the row of paper stacks may be fairly long, and because of the reciprocal movement of the platform 48 the guide channel for receiving the stacks may assume a changing serpentine configuration as shown in FIGS. 2 and 3. This is quite easily accomplished by providing the side walls 78 of the guide channel of flexible material so that flexing is easily possible during operation of the apparatus.

In the use of this apparatus for gummed cigarette paper one longitudinal edge of each of the paper strips will have a line of glue or adhesive. In the orientation shown, the glue on the paper strip will face outwardly so that when the paper is folded and interleaved the glue lines will face inwardly. If the glue lines on the paper on the rolls 8 face inwardly, means for turning the paper over before folding, and interleaving, can be provided.

I claim:

1. Apparatus for folding and interleaving continously moving strips of paper and cutting the interleaved strips into packets of interleaved paper sheets comprising a plurality of rotatably mounted supply rolls of paper strip for continuously supplying strips of paper, a series of formers and interleavers positioned sequentially outwardly from the supply rolls to fold and interleave the strips of paper, drive means for continuously drawing strips of paper from the supply rolls and through the formers and interleavers to to form a strand of interleaved paper strips, a knife for cutting the strand of interleaved paper strips into interleaved packets of paper sheets of predetermined length, the knife being mounted on a movable knife plate carried by a platform, means to reciprocably move the platform in a direction parallel to the direction of travel of the strand of interleaved paper strips a distance equal to the determined length of the packets, means carried by the platform to reciprocably move the knife plate in a direction normal to the reciprocal movement of the platform, the knife plate advancing and the knife severing a packet from the strand during movement of the platform in the same direction and at the same speed as the moving strand, and a pusher plate carried by and movable with the knife plate to displace a severed pocket laterally with respect to the direction of travel of the strand.

2. Apparatus according to claim 1, wherein the rotatably mounted rolls of paper strip are mounted in upper and lower banks, half of the rolls being in each bank.

3. Apparatus according to claim 1, the series of formers and interleavers including a first former having upper and lower horizontal rows of uniformly spaced openings, the openings in the upper row being staggered with respect to the openings in the lower row, one opening being provided for each paper strip, the paper strips passing through the openings in the upper row receiving an inverted V- or U-shaped configuration and the paper strips passing through the openings in the lower row receiving a V- or U-shaped configuration.

4. Apparatus according to claim 3, including a second former spaced from the first former in the direction of movement of the strips, the second former having a horizontally extending opening of saw-tooth configuration providing alternating upwardly and downwardly pointing sections of V-shape, the strips having received an inverted V- or U-shape from the first former passing through the upwardly pointing sections and the strips having received a V- or U-shape from the first former passing through the downwardly pointing sections, the passage of the strips through the second former effecting partial interleaving thereof.

5. Apparatus according to claim 4, including a third former spaced from the second former in the direction of movement of the strips, the third former having an opening of horizontal saw-tooth configuration, the third former having a width less than the width of the opening of the second former to effect substantial interleaving of the strips being drawn therethrough.

6. Apparatus according to claim 1, wherein the drive means comprises a pair of parallel mounted drive rollers and motor means for rotating the drive rollers, the strand of interleaved paper strips passing between and being drawn by the drive rollers.

7. Apparatus according to claim 1, wherein a spring-biased compactor is carried on the knife plate, the compactor contacting the strand prior to severing to laterally compact the strips forming the strand.

8. Apparatus according to claim 1, wherein the knife plate is carried and moved by pneumatic or hydraulic cylinders mounted on the platform.

* * * * *